US012018494B2

(12) United States Patent
Buzon et al.

(10) Patent No.: US 12,018,494 B2
(45) Date of Patent: Jun. 25, 2024

(54) SUPPORT ELEMENT FOR SPACERS AND SET OF A SUPPORT ELEMENT FOR SPACERS AND A SET OF SPACERS

(71) Applicant: Buzon Pedestal International S.A., Herstal (BE)

(72) Inventors: Laurent Buzon, Herstal (BE); Carlo Cosijns, Ishigaki (JP)

(73) Assignee: Buzon Pedestal International S.A., Herstal (BE)

( * ) Notice: Subject to any disclaimer, the term of this patent is extended or adjusted under 35 U.S.C. 154(b) by 140 days.

(21) Appl. No.: 17/681,892

(22) Filed: Feb. 28, 2022

(65) Prior Publication Data

US 2022/0282493 A1 Sep. 8, 2022

(30) Foreign Application Priority Data

Mar. 2, 2021 (BE) ..... 2021/5149

(51) Int. Cl.
*E04F 15/024* (2006.01)
*E04F 15/02* (2006.01)

(52) U.S. Cl.
CPC ..... *E04F 15/02022* (2013.01)

(58) Field of Classification Search
CPC ..... E04F 15/02022; E04F 15/02027; E04F 15/02038; E04F 15/0247; F16M 11/24; Y10T 403/60
USPC ..... 248/276.1; 411/45, 46, 47, 48; 52/126.1, 52/126.5, 126.6, 126.7, 263
See application file for complete search history.

(56) References Cited

U.S. PATENT DOCUMENTS 5,651,634 A * 7/1997 Kraus ..... F16B 5/0628 D8/382
6,254,302 B1 * 7/2001 Kraus ..... F16B 21/09 403/328
8,453,391 B2 * 6/2013 Tabibnia ..... E04F 15/02452 52/126.6
2008/0156233 A1 * 7/2008 Paddock ..... B63B 29/06 108/44
2016/0040439 A1 * 2/2016 Pelc ..... E04D 11/007 52/126.6

FOREIGN PATENT DOCUMENTS

DE 102013113267 6/2015
WO 2020/127397 6/2020

* cited by examiner

*Primary Examiner* — Nkeisha Smith
(74) *Attorney, Agent, or Firm* — Jacobson Holman PLLC

(57) ABSTRACT

Support element for spacers comprising a base provided for being placed on a surface elevation pedestal, which basis is provided with at least a first and a second window having a curved geometry, each window being provided for applying therein one of the spacers in such a manner that the spacer can be freely moved in the window in which it is applied and be guided by that window when being moved, the first and second window each having a start section and a final section, the final section of the first window and the start section of the second window being juxtaposed one to each other in such a manner that a linear axis starting from a centre of the basis in a direction towards an external border of the basis crosses successively the final section of the first window and the start section of the second window.

11 Claims, 7 Drawing Sheets

SUPPORT ELEMENT FOR SPACERS AND SET OF A SUPPORT ELEMENT FOR SPACERS AND A SET OF SPACERS

The present invention relates to a support element for spacers comprising a base provided for being placed on a surface elevation pedestal or a joist, which basis is provided with at least a first and a second window each having a curved geometry, each window being provided for applying therein one of the spacers, the first and second window each having a start section and a final section, which windows are provided in such a manner that the spacer can be freely moved in the window in which it is applied and be guided by that window when being moved.

Such a support element for spacers is known from DE 10 2013 113 267 A1. The known support element for spacers is formed by a circular basis provided with two windows which are applied according to halve a cercle near the external border of the basis. The known support element for spacers is destinated for being placed on the head of a pedestal. It serves for applying therein spacers which can extend between two adjacent slabs which will be placed on the support element for spacers or along a beam. Those spacers enable on their turn to maintain the distance between two adjacent slabs.

A drawback of the known support element for spacers is that, despite the presence of windows, the distance between the spacer and the centre of the support of the spacers remains always the same, which limits the possibilities of applying spacers on the support. This has for consequence that with the known support element for spacers only rectilinear slabs and of equal dimension can be used, which limits considerably the choice of slabs to be placed.

An object of the invention is to realise a support element for spacers which enables a larger possibility for applying the spacers on the support element and thus enable to enlarge the choice of geometry of the slabs to be applied.

To this purpose a support element for spacers according to the invention is characterised in that the final section of the first window and the start section of the second window being juxtaposed one to each other in such a manner that a linear axis starting from a centre of the basis in a direction towards an external border of the basis crosses successively the final section of the first window and the start section of the second window. The fact of being able to move freely the spacer in each window, which moreover is curved in such a manner that the final section of the first window and the start section of the second window are juxtaposed one to each other, offers a large possibility for applying spacers in each of the windows. The curvature of each window and the disposition of the first and second windows enable to bring the spacers closer to the centre of the basis thus not limiting the position of the spacer at a fixed distance of the centre. Thus, a large choice of geometries of the slabs will be allowed, as it will be enough to move the spacer in the window for applying it between two adjacent slabs, even if the latter are not of rectilinear shape or of equal dimension.

It should be noted that WO 2020/127397 describes a support element for spacers where a final section of a first window is juxtaposed to a start section of a second window. Nevertheless, the combination of DE 10 2013 113 267 with WO 2020/127397 does not lead to the present invention. Starting from DE 10 2013 113 267 the skilled person obtains the teaching of applying circular windows having a constant radius. WO 2020/127397 teaches the use of a single circular window in combination with two linear windows. A combination of DE 10 2013 113 267 with WO 2020/127397 leads to add two linear windows to the support element of DE 10 2013 113 267. This solution would not be considered by a skilled person, as not only there is no place on the element of DE 10 2013 113 267 for doing it, or one should have to reduce the dimension of the circular windows, which on its turn would limit the positions for the spacers. Moreover, said combination would still not enable to obtain two windows having a curved geometry of which a final section of a first window is juxtaposed to a start section of a second window. The gist of the present invention thus resides in having partly juxtaposed two windows having a curved geometry.

A first preferred embodiment of a support element for spacers according to the invention is characterised in that each window comprises an interior curved line and an exterior curved line, the interior and exterior curved lines being at equal distance among them over their whole length. In such a manner the opening width of the windows remains the same over the whole length of the window, which enables to retain and guide the spacer over the whole length of the window.

A second preferred embodiment of a support element for spacers according to the invention is characterised in that a start point of the interior curved line located at a height of the starting section is located at a distance of said centre which is at least 25% higher than the one at which a final point of the interior curved line located at a height of the final section is situated with respect to said centre. This enables to have a large number of positions for the spacer, while maintaining a good rigidity of the basis.

A third preferred embodiment of a support element for spacers according to the invention is characterised in that the final section of the first window and the start section of the second window are juxtaposed one to each other over at least 15% of their length. This enables a large number of possibilities for positions for applying the spacer despite a reduced surface.

Preferably at least two longitudinal openings are foreseen in the basis around said centre, the openings extending in parallel to each other. Those are provided for cooperating with an attachment element provided for connecting the support element for spacers to a pedestal or a joist.

Preferably a circular opening is foreseen in the extension and at distance of the final section of at least one window. This circular opening offers more application points for the spacers.

The present invention also relates to a set of support elements for spacers and a set of spacers. Such a set is characterised in that the set off spacers comprises at least a plurality of spacers distributed according to categories, each spacer having each an attachment member provided for connecting the spacer to the window and a head which extends above the basis when the spacer is connected to the window, each category having a predetermined head width, the thickness of the heads of the different categories being different among each other. This enables to have not always the same distance between the slabs.

The invention will now be described in more details with respect to the drawings showing an example of an embodiment of a support element for spacers according to the invention. In the drawings.

In the figures a same reference sign has been allotted to a same element or to a corresponding element.

Figure 1:
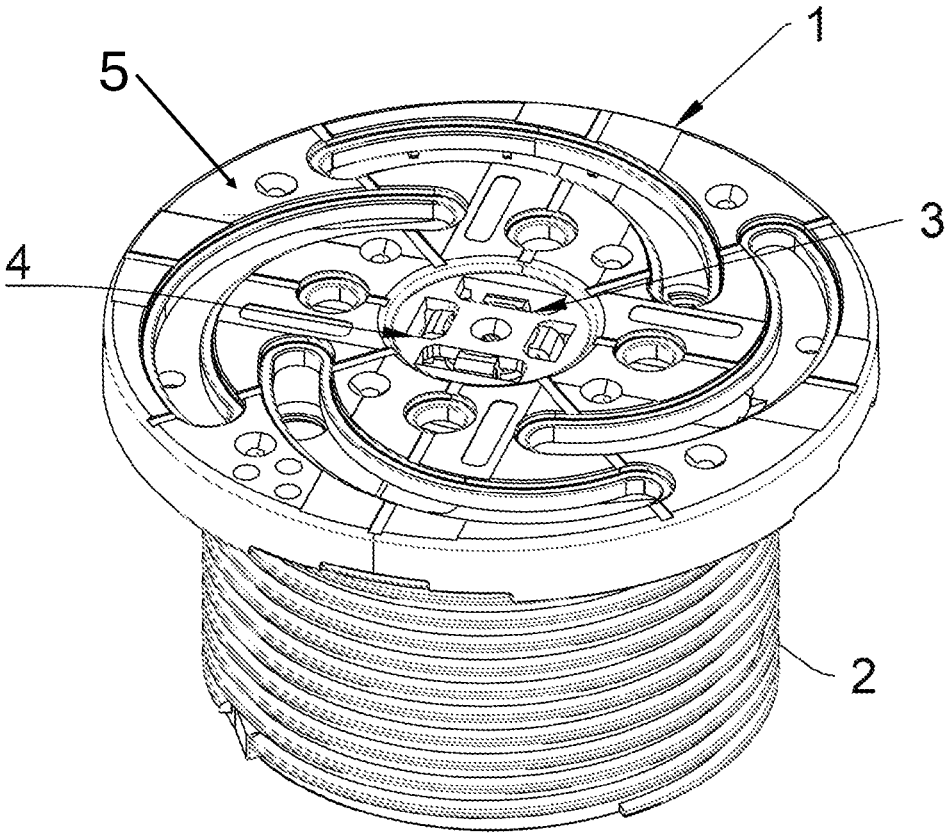
FIG. 1 shows a support element for spacers according to the invention applied on a surface elevation pedestal.

FIG. 1 shows an overall view of a support element 1 for spacers according to the invention and applied on a surface elevation pedestal 2. The pedestal serves to be applied on a ground in such a manner as to apply slabs or a floor at a distance from ground or for compensating an inclined ground. The support element for spacers comprises a basis 5 which is provided with at least two longitudinal openings 3 which are foreseen in the basis around a centre thereof. Preferably the basis comprises two longitudinal openings which extend two by two in parallel with each other. The support element 1 for spacers is connected to the pedestal 2 by means of an attachment element 4 which grips in at least one of the longitudinal openings 3. The attachment element is connected to the pedestal in such a manner as to be able to rotate with respect to the pedestal and thus to enable a rotation of the support element for spacers with respect to the pedestal. Preferably the basis is circular which favourites the rotation of the support element for spacers.

Figure 2:
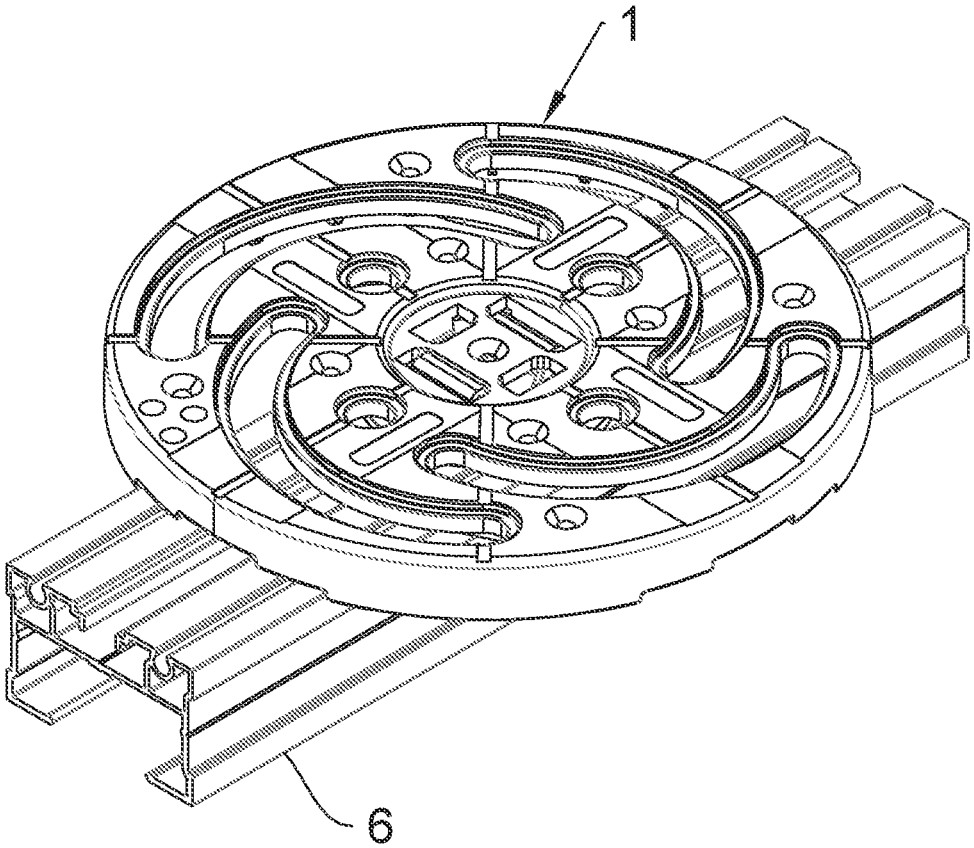
FIG. 2 shows a support element for spacers according to the invention applied on a joist.

FIG. 2 distinguishes over FIG. 1 by the fact that the support element 1 for spacers is applied on a joist 6. The support element for spacers is also connected to the joist by means of an attachment element. Preferably the support element for spacers is connected to the joist in such a manner as to be able to rotate with respect to it and thus enable a rotation of the support element for spacers with respect to the joist.

Figure 3:
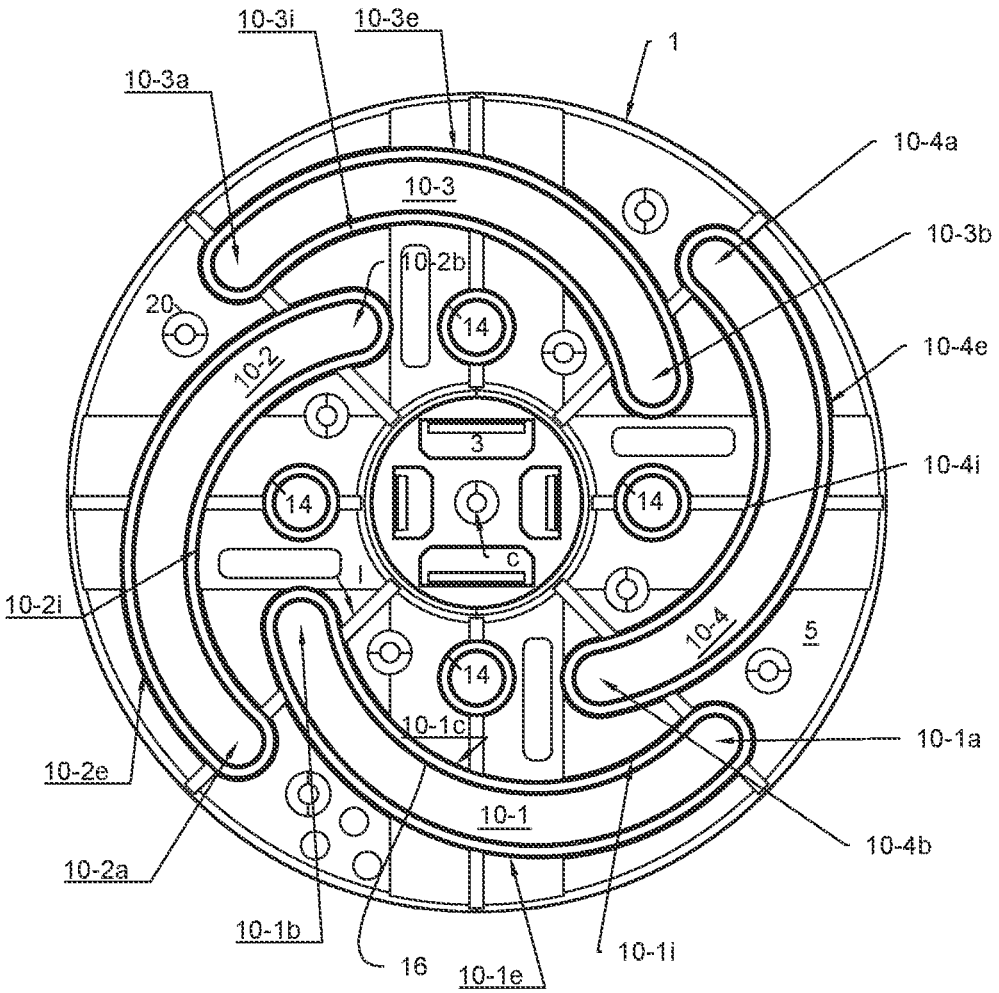
FIG. 3 shows a view of the upper side of a support element for spacers according to the invention.

FIG. 3 shows a view of the upper side of a support element 1 for spacers according to the invention. This element is preferably manufactured in a plastic material, such as for example polypropylene. The basis of the support element for spacers is provided with at least a first 10-1 and a second 10-2 window having a curved geometry. In the embodiment shown in FIG. 3, there is also a third 10-3 and a fourth 10-4 window. Each window 10-1 to 10-4 is provided for applying thereon at least one spacer 13, as illustrated in the FIGS. 5 and 6. Each window has a start section 10-1*a*, 10-2*a*, 10-3*a* and 10-4*a* as well as a final section 10-1*b*, 10-2*b*, 10-3*b* and 10-4*b*. The spacer or spacers 13 can be freely moved in the window in which they are applied and be guided by that window when being moved. The windows are applied in such a manner that the final section 10-1*b* of the first window and the start section 10-2*a* of the second window are juxtaposed one to each other in such a manner that a linear axis I starting from a centre of the basis in a direction towards an external border of the basis crosses successively the final section 10-1*b* of the first window and the start section 10-2*a* of the second window. The final sections 10-2*b*, 10-3*b* and 10-4*b* and the start sections 10-3*a*, 10-4*a* and 10-1*a* are applied in an analogous manner.

Figure 4:
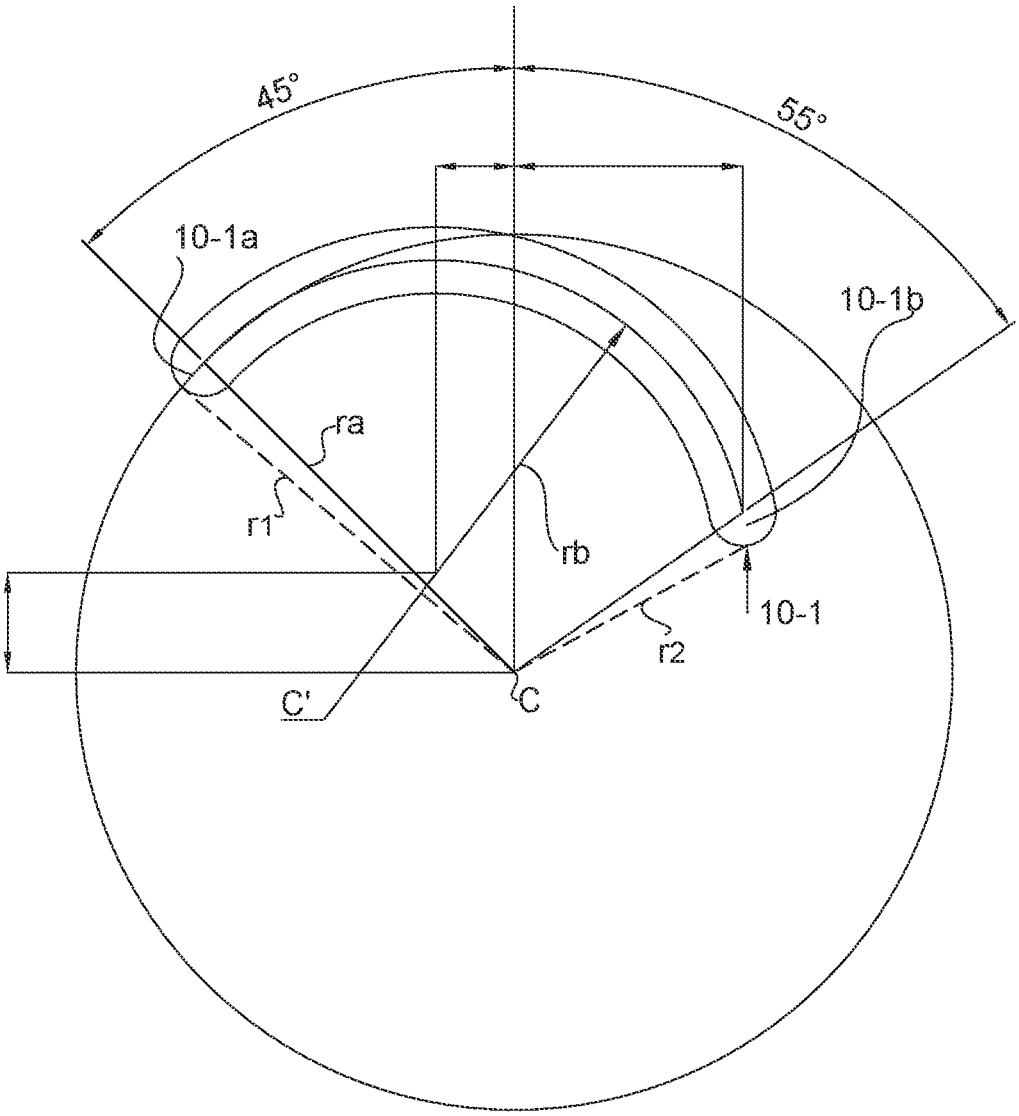
FIG. 4 shows in more details an embodiment of the way how a window is curved.

As illustrated in FIG. 4, preferably the starting point of the start section of each of the windows is located at a same distance $r_1$ of the centre and the final point of the final section of each of the windows is located at a same distance $r_2$ of the centre, $r_1$ being greater than $r_2$.

Each window has an interior curved line 10-1*i*, 10-2*i*, 10-3*i* and 10-4*i* and an exterior curved line 10-1*e*, 10-2*e*, 10-3*e* and 10-4*e*. The interior and exterior curved lines being of equal distance among them over their whole length. This equal distance enables to a spacer introduced in the window to be guided and retained over its whole path in the window.

The curved geometry of the windows is such that a start point of the interior curved line 10-1*i*, 10-2*i*, 10-3*i* and 10-4*i* located at a height of the start section is located at a distance of said centre of the basis which is at least 25% higher, in particular between 25 and 40% higher, than the one at which a final point of the interior curved line at a height of the final section is situated with respect to said centre. Thus, the curved line of the window inclines in a continuous manner towards the centre of the basis and does not follow a circular path of which the radius of the curve remains constant. The interior and exterior curved line are thus inclined towards the centre. This enables to apply spacers in the windows at places which do not have a same distance with respect to the centre of the basis and thus enable to apply a spacer in a continuous manner at different distances from the centre.

Preferably the final section of the first window and the start section of the second window are juxtaposed one to each other over at least 15%, in particular over 15 to 25%, of their length. This also applies to the final section of the second, respectively the third and fourth, window and to the start section of the third, respectively the fourth and the first, window. This enables to multiply the positions of the spacer over a reduced space.

FIG. 4 shows in more details an embodiment of the way how a window is curved. It will be clear that the invention is not limited to the in FIG. 4 shown example and that other curved shapes can be applied. The first window 10-1 is constituted by two sub-sections each having a predetermined curve radius $r_a$ and $r_b$. The first sub-section comprises the start section 10-1*a* and the second sub-section comprises the final section 10-1*b*. The circle fraction which forms the first sub-section has its centre which corresponds with the one C of the basis, whereas the cercle fraction which forms the second sub-section has its centre C' which is offset with respect to the centre C. This offset is as well towards the left as in height with respect to the centre C. The offset towards the left is for example of 12.89 mm and 16.39 mm towards the upper for a circular basis having a radius of 92.58 mm. In the same example the curve radius of the curve $r_a$ being of 72 mm and $r_b$ of 51.352 mm. Due to the use of two different radius of the curve for a same window as well as a different centre for each curve enables exactly to obtain that the final section is lodged under the start section of the subsequent window. The first sub-section extends over approximately a quarter of the window.

Preferably a circular opening 14 (see FIG. 3) is foreseen in the extension and at a distance of the final section of at least one window. In the embodiment shown in FIG. 3 there are four circular openings 14 in such a manner that at each window such a circular opening is associated. These circular openings serve for applying a spacer 13 therein and increase the possibilities for applying spacers. The circular openings are located in the extension of the curve formed by the window with which they are associated. The fact that windows associated with circular openings also has the advantage of rigidifying the basis. Indeed, one could extend the window, but then there is a risk of too much weakening the structure of the basis, which would cause a too easy breaking upon use. The use of windows associated with circular openings thus offers a good compromise between on the one hand sufficient possibilities for applying spacers, and on the other hand a sufficiently rigid basis.

Preferably each window is surrounded with a border 16 foreseen in the basis. This also applies for each circular opening. The border forms a circumference for the window, respectively the circular opening, and is situated offset towards the bottom with respect to the upper surface of the basis. The distance between this border and the upper surface corresponds to the thickness of a support disk 23 (see FIG. 7) of the spacer, which support disk forms the passage between the head 24 and the attachment member 19 of the spacer. Thus, when the spacer is applied in the window or in the circular opening the attachment member extends underneath the window, respectively the circular opening, and the head there above. The support disk 23 rests on the border 16. The cooperation between the attachment member, the support disk and the border will cause that the spacer is maintained in the window of the opening but can nevertheless move therein, i.e., rotate in the circular opening and rotate and slide in the window. This offers a large flexibility for positioning and orienting the head of the spacer.

For facilitating the fixing of the support element for the spacers on the pedestal or the joist after having been positioned, it is preferably equipped with a set of perforations 20 applied along a cercle of which the radius is lower than the one of the bases.

Figure 5:
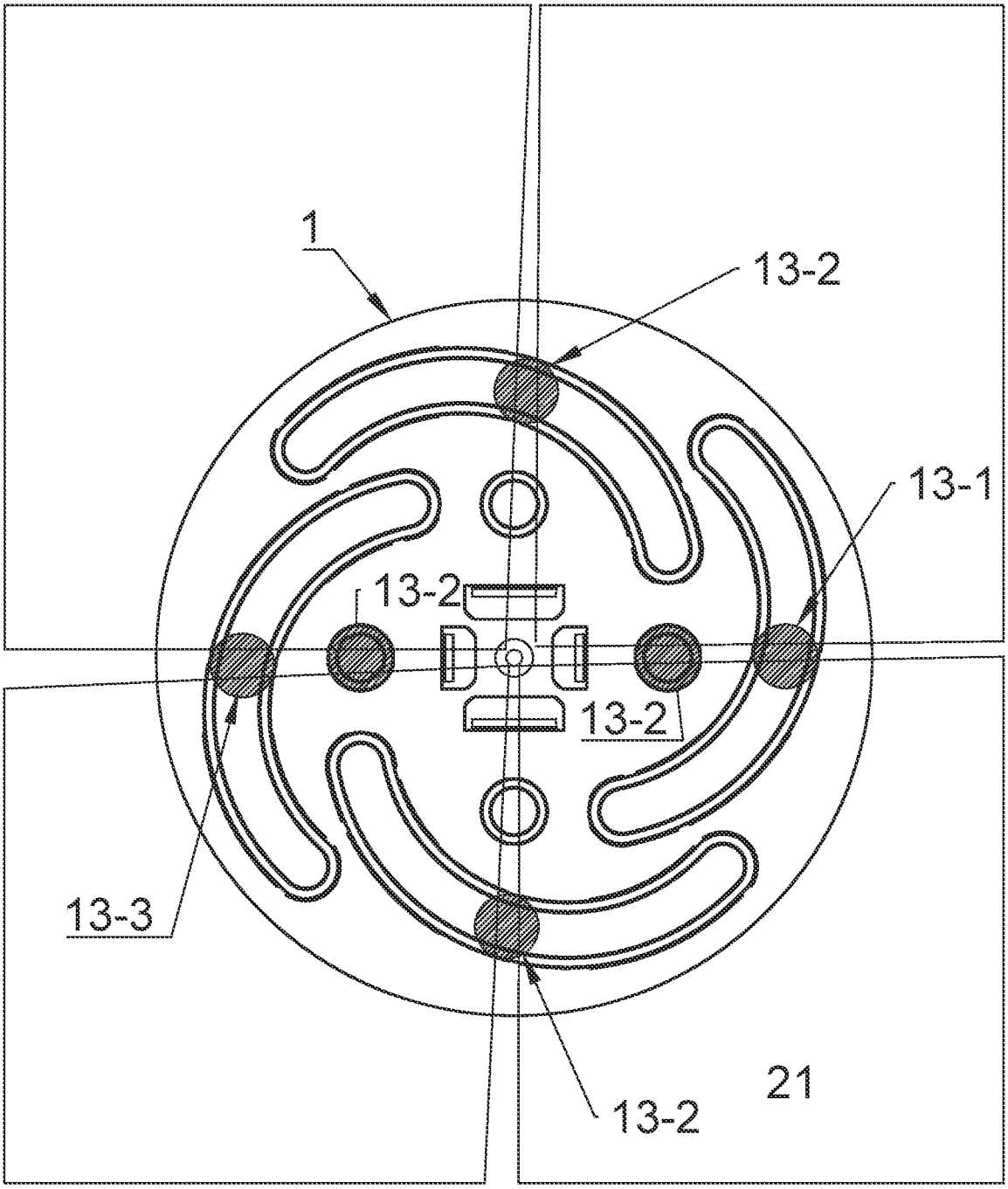
FIG. 5 shows a view of the upper surface of a support element for spacers according to the invention and applied on a pedestal and provided with spacers.
Figure 7:
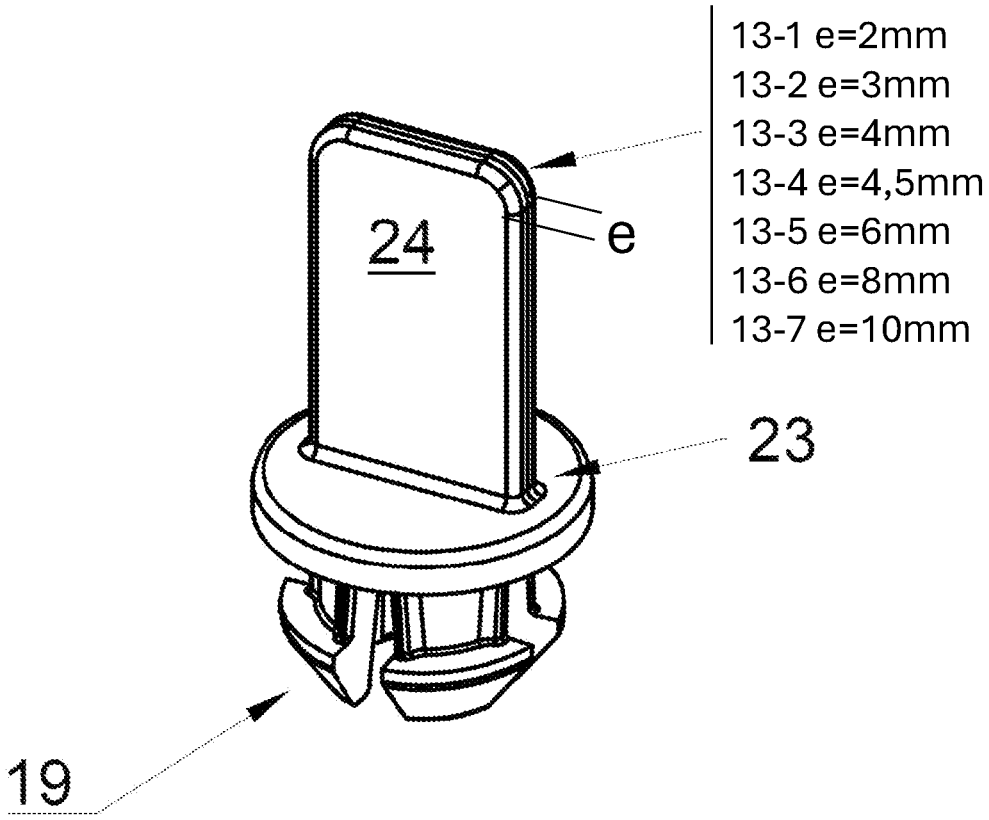
FIG. 7 shows a spacer.

The support element for spacers according to the invention is part of a set which also comprises a set of spacers 13. The set of spacers comprises a plurality of spacers 13. As illustrated in FIG. 7, each spacer 13 has an attachment member 19 and a head 24 which extends above the basis of the support element when the spacer is connected with the window. The spacers of the set are distributed in several categories and each category has well defined head thickness e. Hence, the head thickness of the first category 13-1 of spacers is smaller than the one of the head of the second category 13-2 of spacers. Preferably the set comprises seven categories 13-1 to 13-7 of spacers. The head of the spacer of the first category 13-1 has a thickness e equal to 2 mm, the head of the spacer of the second category 13-2 has a thickness e equal to 3 mm and head of the spacer of the third 13-3 to the seventh 13-7 category has a thickness e equal to 4 mm, respectively 4.5 mm, 6 mm, 8 mm and 10 mm. The use of a set of spacers of which the heads have a different thickness enables to choose the spacer which best fits with the distance between two slabs to be placed. As can be seen in FIG. 5 the slabs are not rectilinear. At the place where the distance between the slabs 21 is smaller one will then use the spacer of the second category 13-2. At the place where the distance between the slabs is substantially larger one will use the spacer the spacer of the seventh category 13-7 and therein between the spacer of the fourth category 13-4. Thus, the slabs will be well blocked among them and the risk that they will be moved is substantially reduced.

Figure 6:
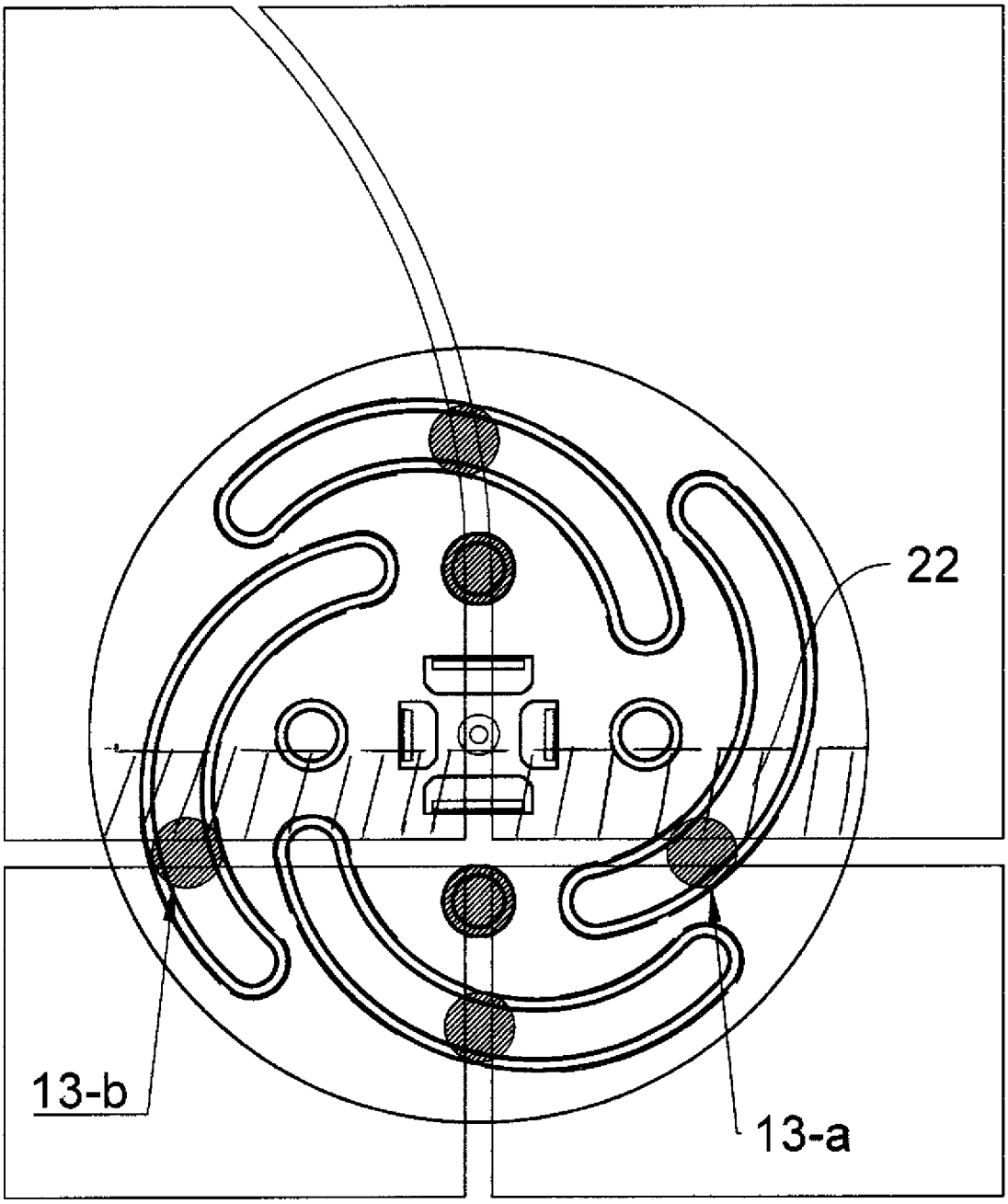
FIG. 6 shows a view of the upper surface of a support element for spacers according to the invention where the point situated between four adjacent slabs is offset with respect to the centre of the pedestal.

As illustrated in FIG. 6, it is not necessary that the point around which the end corner of the four adjacent slabs joins corresponds to the centre of the support element for spacers. FIG. 6 illustrates a situation where this point is offset with respect to the centre. It is the presence of the windows with their geometry which enables this. Indeed, as the window has not a constant curve radius it is not necessary that the spacers are always at the same distance of the centre. One can see at FIG. 6 that the spacer 13-*a* is closer to the centre than the spacer 13-*b* and that they are not the same place in their respective window. This thus offers to the one who applies the slabs a larger flexibility, as the centre of the pedestal does not necessarily have to correspond with said point between the corners of the slabs. Thus for example when it is not possible to apply a pedestal at the place of said point, for example due to the presence of an obstacle, it will be enough to place the pedestal offset and to rotate the support of the spacers in such a manner as to place the spacers in a window or as the case may be a circular opening.

Preferably the support element for spacers according to the invention comprises an indication 22, for example by application of a streak or a wave profile, indicating the zone with respect to the centre over which said offset can be done while maintaining the stability of the pedestal, the support element for spacers and the slabs which will be applied thereon. Preferably this indication extends over a surface equal to a quarter of the surface of the support element for spacers starting from a line which crosses the centre for thereafter going in a direction going from the border of the support element for spacers. This enables then to persons applying the slabs to easily see the limits between which the offset can be done.

When placing the slabs, after application of the support element for spacers, the slabs will be applied one by one, and the spacers will be applied between the slabs by having them sliding in the window.

The invention claimed is:

1. Support element for spacers comprising a basis provided for being placed on a surface elevation pedestal or a joist, which basis is provided with at least a first and a second windows each having a curved geometry, each window comprising an interior curved line and an exterior curved line, the interior and exterior curved lines being at equal distance among them over their whole length, each window being provided for applying therein one of the spacers, the first and second windows each having a start section and a final section, wherein the windows are provided in such a manner that the spacer can be freely moved in the window in which it is applied and be guided by that window when being moved, and wherein the final section of the first window and the start section of the second window being juxtaposed one to each other in such a manner that a linear axis starting from a centre of the basis in a direction towards an external border of the basis crosses successively the final section of the first window and the start section of the second window.

2. Support element for spacers according to claim 1, characterised in that a starting point of the interior curved line located at a height of the start section is located at a distance of said centre which is at least 25% higher than at which a final point of the interior curved line located at a height of the final section is situated with respect to said centre.

3. Support element for spacers according to claim 1, characterised in that interior and exterior curved line is inclined towards said centre.

4. Support element for spacers according claim 1, characterised in that the final section of the first window and the start section of the second window are juxtaposed one to each other over at least 15% of their length.

5. Support element for spacers according to claim 1, characterised in that it the support element is circular.

6. Support element for spacers according to claim 1, characterised in that a circular opening is located at distance of the final section of at least one window in an extension of the curved geometry of that window with which the circular opening is associated.

7. Support element for spacers according to claim 1, characterised in that at least two longitudinal openings are foreseen in the basis around said centre, the openings extending in parallel to each other.

8. Support element for spacers according to claim 1, characterised in that each window is surrounded with a border.

9. Support element for spacers according to claim 1, characterised in that said support element comprises a set of perforations applied along two lines which are perpendicular to one another.

10. Support element for spacers according to claim 1, characterised in that the basis comprises an indication indicating a zone on which an offset with respect to the centre can be made.

11. A set of support elements for spacers and a set of spacers, each of said support elements for spacers comprising a basis provided for being placed on a surface elevation pedestal or a joist, which basis is provided with at least a first and a second window each having a curved geometry, each window being provided for applying therein one of the spacers, the first and second window each having a start section and a final section, wherein the windows are provided in such a manner that the spacer can be freely moved in the window in which it is applied and be guided by that window when being moved, and wherein the final section of the first window and the start section of the second window being juxtaposed one to each other in such a manner that a linear axis starting from a centre of the basis in a direction towards an external border of the basis crosses successively the final section of the first window and the start section of the second window, and wherein said set of spacers comprises at least a plurality of spacers distributed according to categories, each spacer having each an attachment member provided for connecting the spacer to a window and a head which extends above the basis when the spacer is connected to a window, each category having a predetermined head width, the thickness of the heads of the different categories being different among each other.

* * * * *